US009318808B1

(12) United States Patent
Weaver et al.

(10) Patent No.: US 9,318,808 B1
(45) Date of Patent: Apr. 19, 2016

(54) CONFIGURABLE ELECTROMAGNETIC REFLECTOR

(75) Inventors: Thomas L. Weaver, Webster Groves, MO (US); Johann F. Thaheld, Seattle, WA (US)

(73) Assignee: The Boeing Company, Chicago, IL (US)

( * ) Notice: Subject to any disclaimer, the term of this patent is extended or adjusted under 35 U.S.C. 154(b) by 873 days.

(21) Appl. No.: 13/594,365

(22) Filed: Aug. 24, 2012

(51) Int. Cl.
*H01Q 1/28* (2006.01)
*H01Q 15/14* (2006.01)

(52) U.S. Cl.
CPC ..... *H01Q 15/148* (2013.01)

(58) Field of Classification Search
CPC ..... H01Q 15/148; H01Q 1/286; H01Q 3/44
USPC ..... 342/5, 371; 343/705, 708, 912; 977/742, 950
See application file for complete search history.

(56) References Cited

U.S. PATENT DOCUMENTS

| | | | | |
|---|---|---|---|---|
| 7,286,210 | B2 | 10/2007 | Pettit | |
| 7,333,055 | B2 * | 2/2008 | Baharav | G01S 13/89 342/179 |
| 8,013,359 | B2 | 9/2011 | Pettit | |
| 8,044,866 | B2 | 10/2011 | Weaver | |
| 2010/0265138 | A1 * | 10/2010 | Biem et al. | 342/442 |
| 2011/0180661 | A1 * | 7/2011 | Weaver | H01Q 1/286 244/1 R |

* cited by examiner

*Primary Examiner* — Timothy A Brainard
(74) *Attorney, Agent, or Firm* — Toler Law Group, PC

(57) ABSTRACT

Configurable passive electromagnetic reflectors are disclosed, as are aircraft comprising configurable passive electromagnetic reflectors and methods to use configurable passive electromagnetic reflectors. In one embodiment a system comprises a reflector comprising a surface having a plurality of addressable patches switchable between a reflective state and a non-reflective state, and a controller coupled to the reflector to provide signals to switch the plurality of addressable patches between the non-reflective state and the reflective state to configure the reflector to selectively reflect incident electromagnetic radiation toward a remote target. Other embodiments may be described.

20 Claims, 3 Drawing Sheets

CONFIGURABLE ELECTROMAGNETIC REFLECTOR

BACKGROUND

The subject matter described herein relates to electronic communication and configurable electromagnetic reflectors for use in such systems.

Vehicles such as aircraft, ships, or even land-based vehicles may be subject to surveillance by electromagnetic means, e.g., by RADAR systems or the like. In some circumstances it may be useful to collect the electromagnetic signals used in a surveillance system.

SUMMARY

In one embodiment a system comprises a reflector comprising a surface having a plurality of addressable patches switchable between a reflective state and a non-reflective state, and a controller coupled to the reflector to provide signals to switch the plurality of addressable patches between the non-reflective state and the reflective state to configure the reflector to selectively reflect incident electromagnetic radiation toward a remote target.

In another embodiment, a vehicle comprises a body having an outer surface, a reflector mounted on the outer surface and comprising a surface having a plurality of addressable patches switchable between a reflective state and a non-reflective state, and a controller coupled to the reflector to provide signals to switch the plurality of addressable patches between the non-reflective state and the reflective state to configure the reflector to selectively reflect incident electromagnetic radiation toward a remote target.

In another embodiment, a method comprises receiving, at a reflector comprising a surface having a plurality of addressable patches switchable between a reflective state and a non-reflective state, a radio frequency signal from a remote source, and switching the plurality of addressable patches between the non-reflective state and the reflective state to configure the reflector to selectively reflect incident electromagnetic radiation toward a remote target.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

Embodiments of methods and systems in accordance with the teachings of the present disclosure are described in detail below with reference to the following drawings.

DETAILED DESCRIPTION

Configurations for configurable electromagnetic reflectors suitable for use on vehicles or other structures are described herein. In some embodiments configurable electromagnetic reflectors may be mounted on vehicles or other structures which are subjected to electronic surveillance. A receiver coupled to the configurable electromagnetic reflectors may detect the frequency and direction of electromagnetic radiation incident on the reflectors, and a controller coupled to the configurable electromagnetic reflectors may configure the reflectors to reflect the incident radiation toward a remote target. By way of example, in some embodiments configurable electromagnetic reflectors may be mounted on a low-value vehicle such as an unmanned aircraft. The low-value vehicle may be flown or otherwise transported into an area in which it is subject to electromagnetic surveillance, and the electromagnetic surveillance signals may be reflected from the low-value vehicle to a remote target outside the surveillance area.

Specific details of certain embodiments are set forth in the following description and the associated figures to provide a thorough understanding of such embodiments. One skilled in the art will understand, however, that alternate embodiments may be practiced without several of the details described in the following description.

The invention may be described herein in terms of functional and/or logical block components and various processing steps. For the sake of brevity, conventional techniques related to data transmission, signaling, network control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description may refer to components or features being "connected" or "coupled" or "bonded" together. As used herein, unless expressly stated otherwise, "connected" means that one component/feature is in direct physical contact with another component/feature. Likewise, unless expressly stated otherwise, "coupled" or "bonded" means that one component/feature is directly or indirectly joined to (or directly or indirectly communicates with) another component/feature, and not necessarily directly physically connected. Thus, although the figures may depict example arrangements of elements, additional intervening elements, devices, features, or components may be present in an actual embodiment.

Figure 1:
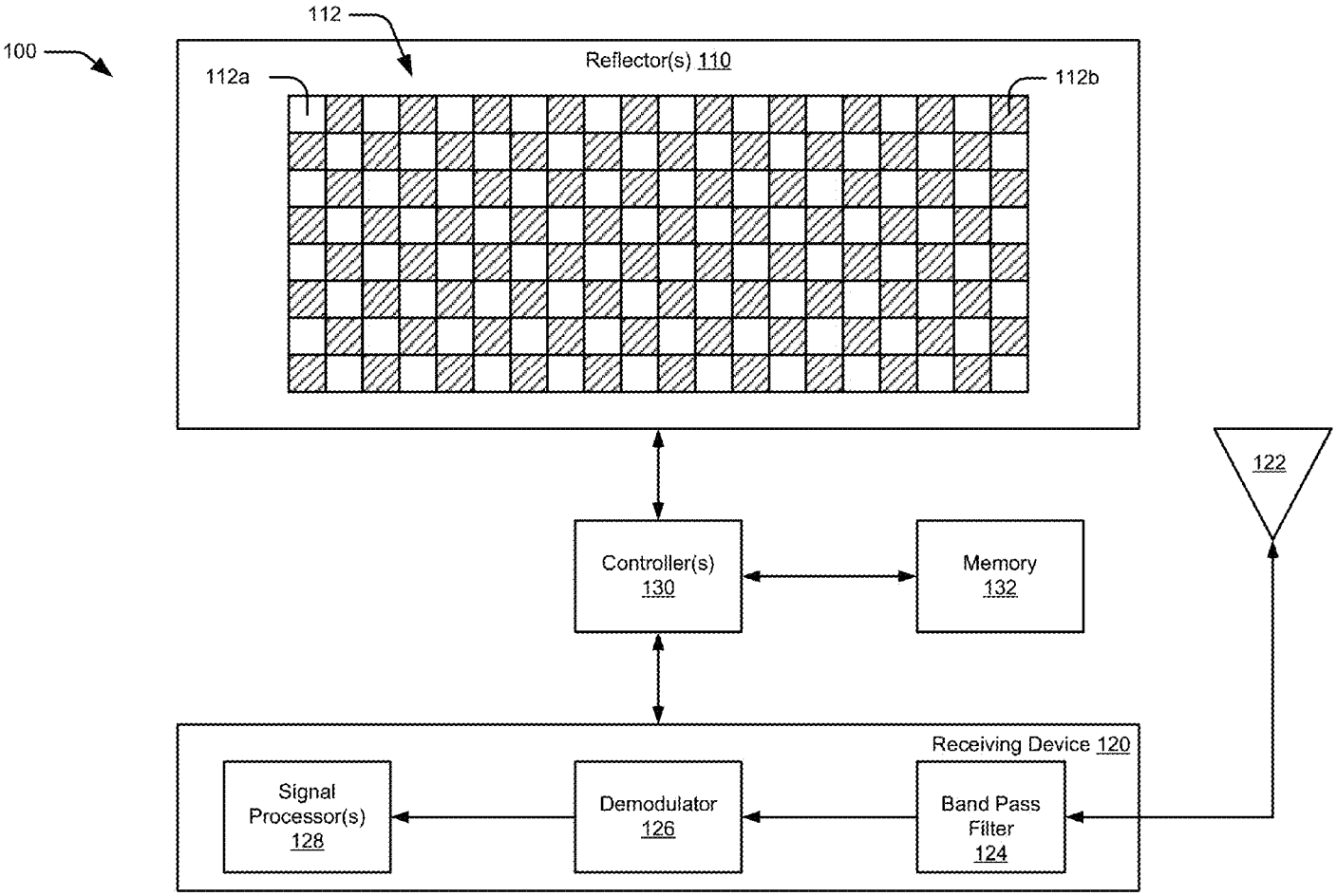
FIG. 1 is a schematic illustration of a system comprising a configurable electromagnetic reflector, according to embodiments.

FIG. 1 is a schematic illustration of a system comprising a configurable electromagnetic reflector, according to embodiments. Referring to FIG. 1, in some embodiments a system 100 comprises a one or more reflectors 110. In system 100 being described herein, the reflectors are a mixture of patches 112, which may be configured to be reflective 112*a* and non-reflective 112*b* patches of carbon nanotubes. Reflector 110 is coupled to a controller 130 which is, in turn, coupled to a memory 132. A receiving device, e.g., a radiofrequency (RF) receiver 120 may be coupled to an antenna 122 to receive an RF signal. Receiving device 120 comprises one or more band pass filters 124, demodulators 126, and signal processors 128 to process received RF signals. Controller 130 is coupled to receiving device 120.

The patches 112*a* become reflective when an optical signal illuminates the patch 112*a*, but otherwise remain in a non-reflective state 112*b*. Patches 112*a*, 112*b* are individually addressable using optical signals as described below to selectively enable a portion of patches 112*a* to become reflective. Moreover, patches 112 are individually addressable using optical signals as described herein to selectively disable a portion of patches 112*b* resulting in the disabled patch being non-reflective.

Figure 2:
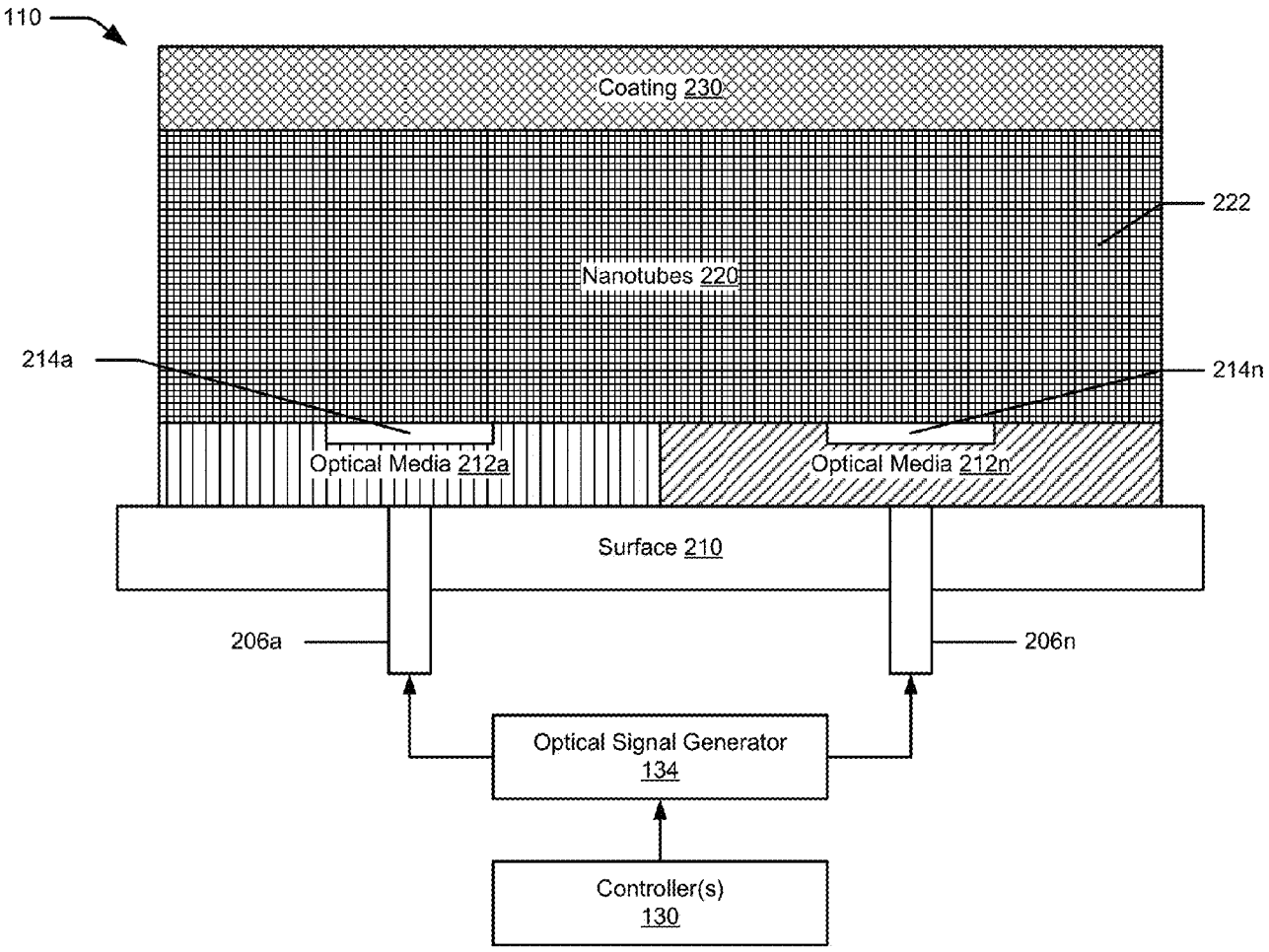
FIG. 2 is a schematic side elevation view of a configurable electromagnetic reflector, according to embodiments.

FIG. 2 is a schematic side elevation view of a configurable electromagnetic reflector 110, according to embodiments. A reflector 110 is shown in FIG. 2 comprises optical media 212*a*-212*n*, (such as optical guides) coupled to a two-dimensional array of many small domains of carbon nanotubes/photo-sensitizers 220 (shown as horizontal lines in FIG. 2), with each region or domain being individually optically addressable. Optical media 204*a*-204*n* may be supplied with a light signal via optical fibers 206*a*-206*n*. Disposed adjacent optical media 204*a*-204*n* coupled with carbon nanotubes 208 is photosensitive material 222. Covering carbon nanotubes 220 is coating 230 that may be used to protect the carbon nanotubes 220 from the environment.

The reflector 110 may be coupled to a surface 210 of a vehicle, e.g., an aircraft, a satellite, a ship, or a land-based vehicle, or to a structure, e.g., a building or a tower. The controller 130 depicted in FIG. 1 is coupled to an optical signal generator 134 which generates optical signals to illuminate the patches 112. Optical signal generator is coupled to the patches 112 via an array of optical fibers Using the array of optical fibers 206*a*-206*n*, a surface with a pattern of varying conductivities may be created by sending optical signals of different intensities to each of the regions of carbon nanotubes 220. Furthermore, by changing the number and location of optical signals applied to the regions, the pattern of conductivity of the surface could be changed. By changing the orientation of the pattern, the direction in which a reflector 110 reflects incident radiation may be altered. The frequency of operation may be changed by raising and lowering the number of contiguous regions that have the same conductivity to change the size scale of the pattern.

Each of the arrays of small elements contains large numbers of carbon nanotubes 220 with either physically or chemically attached photosensitive materials 222. In turn, nanotubes 220 are addressed by optical signals, which are used to control the switching of the nanotubes back and forth between their metallic and non-metallic states. Optical media 204*a*-204*n* may have openings 214*a*-214*n* in which the optical signal may emanate through to illuminate photosensitive material 222. The elements of nanotubes are arranged in an array on a surface which may be flat or have a complex configuration. The nanotubes 220 may be physically or randomly aligned.

Examples of the photo-generating material 222 include photosensitive materials such as CdS and CdSe, which are well known photosensitive materials with good optical efficiencies as well as response times. It is believed that the photo-generated charge from the CdS or CdSe acts through quantum capacitance to alter the Fermi level and thus to alter the conductivity of the carbon nanotube.

Another photo-generating technique which can be used in the present invention was disclosed at the American Physical Society annual meeting in March, 2004, in Montreal, Quebec, Canada. In a presentation at that meeting by Matthew S. Marcus et al entitled "Photo-gated Carbon Nanotube FET Devices," the ability was disclosed to use visible light from a HeNe laser to gate a single walled carbon nanotube FET (CNTFET). The transistor devices were fabricated on SiO,/p-Si substrates, where the p-Si was used as a gate for the nanotube channel. The light was absorbed not only by the carbon nanotube, producing photocurrents, but also in the silicon gate, which produced a photo-voltage at the interface between the Si and the SiO5. Changes were observed in the channel current of up to 1 nA using light to photo gate the CNTFET.

Yet another possibility is the use of photosensitive polymers ("photo-polymers"). A number of research papers have presented results and discussions of employing polymers with carbon nanotubes to create optoelectronic devices. The polymers are typically in contact with the carbon nanotubes 208 to functionalize the nanotubes, rather than being covalently bonded to the nanotubes. The charge formed when the polymer absorbs light creates a photo-voltage near the nanotube surface and modifies the nanotubes conductivity in the way that has been described above. It has been discussed that this "wrapping" of the polymer around the nanotube has advantages over covalently linking the polymer to the nanotube, because the covalent linking chemically alters the nanotube structure. Examples of creating photosensitive polymers with carbon nanotubes are described in "Starched Carbon Nanotubes" by A. Star, D. W. Steuerman, J. R. Heath and J. F. Stoddart, Angew. Chem., Int. Ed. 41 (2002), p. 2508.

Photo-polymers have interestingly large photon cross sections and the presence of the nanotube tends to inhibit the emissions of luminescence photons from a photo-polymer in favor of a charge transfer effect on the nanotube that gives rise to the modulation of the nanotubes conductivity. Rather large photo-electric gains have been reported for these polymercarbon nanotube hybrid structures, on the order of 10.sup.5 electron increase in the nanotube conduction for every photon absorbed by the polymer.

Another aspect to the operation of this system is the application of a recently discovered property of carbon nanotubes, which is, carbon nanotubes can be switched between conductive and non-conductive forms by means of extremely strong local electric fields. Such fields can be produced by an optical signal altering the electrical state of a photosensitive material very close to the nanotubes. Thus, optical signals can control changes in the electrical conductivity of an array of nanotubes and so produce a reflector which can steer an electromagnetic beam.

Shortly after carbon nanotubes were discovered, it was determined that they came in many types, with a variety of properties. Of importance to this disclosure is that one of the properties which vary greatly among different types of nanotubes is electrical conductivity. A property which does not vary is the high resistance of carbon nanotubes to being affected in any way by external electromagnetic fields until the fields become very large, such as that produced by actual contact of a terminal with the nanotube. Recent measurements have indicated that exposing a nanotube to external electric fields will not alter its conductivity until the field strength approaches two million volts per meter (i.e., approximately the field strength at which the gases in the atmosphere at sea level ionize, which means that stronger fields cannot be produced in the atmosphere). Therefore, for all practical purposes, any device using carbon nanotubes that is used within the earth's atmosphere will be immune to effects from external electromagnetic fields. Therefore, a pattern of regions of high and low electrical conductivity on a surface made by covering the surface with a pattern containing conductive and non-conductive carbon nanotubes will not be altered by any RF energy which impinges upon it. Additionally, the pattern will not be altered by electrical signals it is supposed to process, nor will it be affected by radio frequency weapons that might be considered to be a threat.

Even though the electrical conductivity of a carbon nanotube will not be affected by an external electromagnetic field, the conductivity can be altered by placing on the surface of a nanotube a molecule that is either electrically charged or electrically polarized. Having a charged or polarized molecule in physical contact with a nanotube alters the electron wave functions that the nanotube can support, and therefore can alter the conductivity of the nanotubes. Carbon nanotubes can be prepared in systems which have the nanotubes in contact with molecules which change their electronic states and related optical states in response to impinging light. Because light-induced electronic changes at the molecular and nanoscale are quantum effects, they are highly dependent upon the energy of the impinging photons. Photons of radio frequency energy, which are much lower in energy than photons of light, will not affect such a system at all, no matter how intense the radio frequency signal. Thus a nanotube-photosensitive molecule combination is a switch that changes its conductivity in response to light, but not in response to external radio frequency electromagnetic fields.

A potentially important feature of this disclosure is that the individual regions of nanotubes can be made quite small if necessary, on the order of microns in linear dimensions. That means the patterned surfaces could be used for shaping RF transmissions in the lower terahertz frequency range. How high in frequency the surfaces could be effective would depend upon how small the regions could be made.

Figure 3:
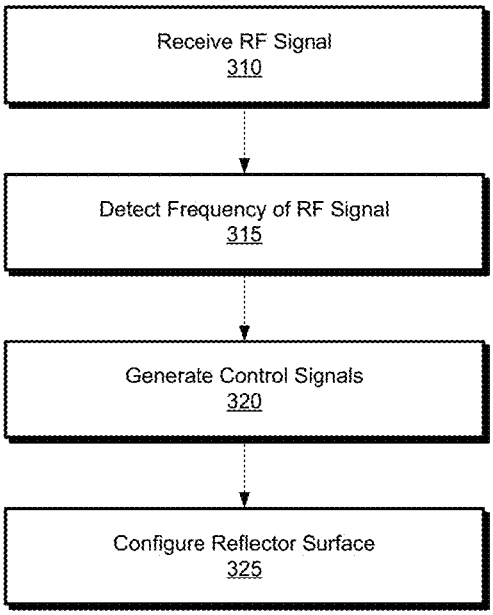
FIG. 3 is a flowchart illustrating operations in a method to reflect a radiofrequency signal, according to embodiments.

Having described structural features of a configurable reflector 110, attention will now be directed to operation of a system to reflect electromagnetic radiation. FIG. 3 is a flowchart illustrating operations in a method to reflect a radiofrequency signal, according to embodiments. Referring to FIG. 3, at operation 310 a radiofrequency signal is received at the system 100 may originate from RADAR systems or other radiofrequency communication systems. The antenna 122 receives the radiofrequency signal and passes the signal to the receiving device 120, which filters, demodulates, and processes the signal.

At operation 315, the frequency band of the incoming radio frequency signal is detected. The frequency may be detected in the receiving device 120 or in the controller 130. At operation 320, the controller 130 generates control signals to activate patches of the reflector 110 such that the portions of the patches 112*a* are reflective and portions of the patches 112*b* are non-reflective. In some embodiments the controller configures (operation 325) the reflector to reflect the incident radiation toward a remote target.

Figure 4:
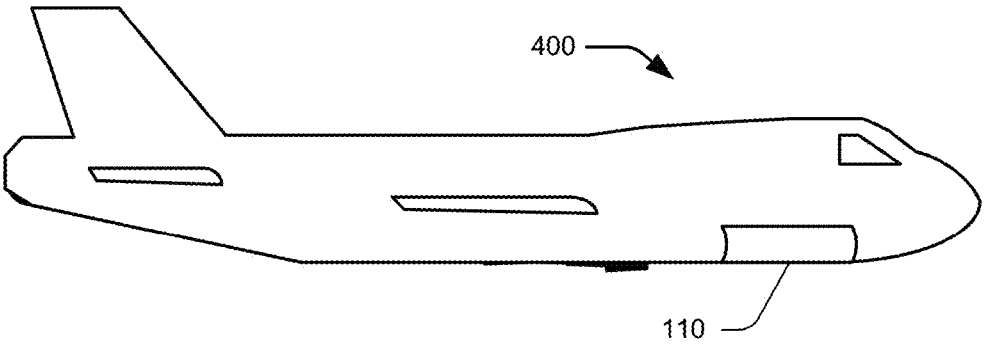
FIG. 4 is a schematic illustration of an aircraft incorporating a configurable electromagnetic reflector, according to embodiments.

Thus, the operations depicted in FIG. 3 configure the system depicted in FIGS. 1 and 2 to selectively reflect radiofrequency signals incident on the reflector toward a remote target. In some embodiments the reflector 110 may be mounted on a surface of an aircraft 400, as depicted in FIG. 4. When the aircraft is subjected to incident radiofrequency signals, e.g., from a RADAR system, the controller may configure the reflector 110 to reflect the incident radiofrequency signals to a remote target. In some embodiments the remote target may be another aircraft or a land-based installation which may be outside the range of the RADAR system.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A system, comprising:

a reflector comprising a surface having a plurality of addressable patches switchable between a reflective state and a non-reflective state; and a controller coupled to the reflector, the controller configured to:

determine a frequency and a direction of incident electromagnetic radiation;

determine a reflector configuration to reflect the incident electromagnetic radiation to a remote target; and provide signals to switch at least a portion of the plurality of addressable patches between the non-reflective state and the reflective state to configure the reflector to reflect the incident electromagnetic radiation to the remote target based on the reflector configuration.

2. The system of claim 1, wherein the plurality of addressable patches comprise optically addressable carbon nanotube patches, and wherein the controller is coupled to the plurality of addressable patches through optical media.

3. The system of claim 2, wherein the carbon nanotube patches are switchable between a metallic state and a non-metallic state.

4. The system of claim 2, wherein the optical media comprises one or more optical waveguides, and wherein the controller is optically coupled to the optical waveguides via one or more optical fibers.

5. The system of claim 1, wherein the remote target corresponds to a position of an aircraft.

6. The system of claim 1, wherein the reflector is coupled to an exterior surface of a vehicle.

7. The system of claim 6, wherein the vehicle comprises an aircraft, a water borne vehicle, a land based vehicle, or a land based vehicle.

8. A vehicle, comprising:

a body having an outer surface;

a reflector mounted on the outer surface and comprising a surface having a plurality of addressable patches switchable between a reflective state and a non-reflective state; and a controller coupled to the reflector, the controller configured to:

determine a frequency and a direction of incident electromagnetic radiation;

determine a reflector configuration to reflect the incident electromagnetic radiation to a remote target; and provide signals to switch at least a portion of the plurality of addressable patches between the non-reflective state and the reflective state to configure the reflector to reflect the incident electromagnetic radiation to the remote target based on the reflector configuration.

9. The vehicle of claim 8, wherein the plurality of addressable patches comprise optically addressable carbon nanotube patches, and wherein the controller is coupled to the plurality of addressable patches through optical media.

10. The vehicle of claim 9, wherein the carbon nanotube patches are switchable between a metallic state and a non-metallic state.

11. The vehicle of claim 9, wherein the optical media comprises one or more optical waveguides, and wherein the controller is optically coupled to the optical waveguides via one or more optical fibers.

12. The vehicle of claim 8, wherein the remote target corresponds to a position of an aircraft.

13. The vehicle of claim 8, wherein the reflector substantially conforms to the outer surface of the vehicle.

14. The vehicle of claim 13, wherein the vehicle comprises an aircraft, a water borne vehicle, or a land based vehicle.

15. A method, comprising:

receiving, at a reflector comprising a surface having a plurality of addressable patches switchable between a reflective state and a non-reflective state, a radio frequency signal from a remote source;

determine a frequency and a direction of the radio frequency signal;

determine a reflector configuration to reflect the radio frequency signal to a remote target; and switching at least a portion of the plurality of addressable patches between the non-reflective state and the reflective state to configure the reflector to reflect the incident electromagnetic radiation to the remote target based on the reflector configuration.

16. The method of claim 15, wherein the plurality of addressable patches comprise optically addressable carbon nanotube patches.

17. The method of claim 16, wherein the carbon nanotube patches are switchable between a metallic state and a non-metallic state.

18. The method of claim 16, wherein the radio frequency signal is a radar signal from a radar system, and wherein the remote target corresponds to a land-based installation outside a range of the radar system.

19. The method of claim 15, wherein the reflector is coupled to an exterior surface of a vehicle.

20. The method of claim 19, wherein the vehicle comprises an aircraft, a water borne vehicle, or a land based vehicle.

* * * * *